US008282419B2

(12) United States Patent
Chang

(10) Patent No.: US 8,282,419 B2
(45) **Date of Patent: *Oct. 9, 2012**

(54) ESATA CONNECTOR STRUCTURE

(76) Inventor: Nai-Chien Chang, Sanchong (TW)

( * ) Notice: Subject to any disclaimer, the term of this patent is extended or adjusted under 35 U.S.C. 154(b) by 130 days.

This patent is subject to a terminal disclaimer.

(21) Appl. No.: 12/946,830

(22) Filed: Nov. 15, 2010

(65) Prior Publication Data

US 2011/0159735 A1 Jun. 30, 2011

(30) Foreign Application Priority Data

Dec. 25, 2009 (TW) ..... 98224433 A

(51) Int. Cl.
*H01R 13/66* (2006.01)

(52) U.S. Cl. ..... 439/620.22; 439/660

(58) Field of Classification Search ..... 439/620.22, 439/620.19, 620.32, 660, 607.51, 607.53, 439/607.55, 607.58

See application file for complete search history.

(56) References Cited

U.S. PATENT DOCUMENTS 5,879,193 A * 3/1999 Thenaisie et al. ..... 439/607.53
6,027,375 A * 2/2000 Wu ..... 439/607.02
6,086,429 A * 7/2000 Wu ..... 439/676
6,450,837 B1 * 9/2002 Givens et al. ..... 439/620.19
7,927,145 B1 * 4/2011 Chang ..... 439/607.31
7,927,148 B2 * 4/2011 Chang ..... 439/620.16
8,123,570 B2 * 2/2012 Chang ..... 439/676
2008/0132123 A1 * 6/2008 Milette et al. ..... 439/676

* cited by examiner

*Primary Examiner* — Xuong Chung Trans

(74) *Attorney, Agent, or Firm* — Chun-Ming Shih; HDLS IPR Services

(57) ABSTRACT

An improved eSATA connector structure includes a base, a circuit board, a chassis and a casing. The base includes a containing space, a retaining wall formed at a front end of the containing space, and an opening formed on the retaining wall. The circuit board is installed in the containing space and passed through the opening and out of the retaining wall, and at least one surface of the circuit board has a plurality of conductive pins, and a transmission line segment is extended from an end of each conductive pin and electrically coupled to a conductive terminal. The chassis is installed in the containing space and includes through holes for passing out conductive terminals, and the casing is installed at the exterior of the base and includes a hollow main body, and a port is formed at a front end of the hollow main body for exposing the circuit board.

10 Claims, 5 Drawing Sheets

ESATA CONNECTOR STRUCTURE

FIELD OF THE INVENTION

The present invention relates to a connector, in particular to an improved eSATA connector structure.

BACKGROUND OF THE INVENTION

In general, an eSATA connector includes a base, a plurality of conductive pins and a metal casing. In a manufacturing process, a thin metal sheet is stamped to produce the conductive pins. After the base made of a plastic material is formed in an injection molding process, the conductive pins are combined with the base, or the stamped conductive pins are placed into a mold and then integrally formed with the base by the injection molding process, such that an end of each conductive pin is fixed onto a tongue plate of the base, and another end of each conductive pin is extended to the exterior of the metal casing after the base is assembled with the metal casing.

Since the base and the conductive pins of the eSATA connector are manufactured separately, small flexible pillar-shaped objects will be produced after the conductive pins are formed by the stamping process, and thus it is not easy to install the eSATA connector into a pin slot of the tongue plate of the base. If the conductive pins are placed into the mold and integrally formed with the base by the injection molding process, and the conductive pins and the base are not connected closely enough, ends of the conductive pins may be warped slightly, such that after a plug of an external eSATA transmission line is inserted, the conductive pins may be crooked or unable to contact with the pins in the plug of the eSATA transmission line, and thus resulting in a failure of transmitting electric signals.

If an electronic component is installed or added inside the eSATA connector or an electronic circuit (including a circuit board) is expanded, the conventional eSATA connector has very limited internal space, such that the electronic component or electronic circuit cannot be added, or after the electronic circuit (including a circuit board) is added into the eSATA connector directly, the new-generation eSATA connector becomes larger and incompatible with the use of other mainboards.

SUMMARY OF THE INVENTION

In view of the aforementioned shortcomings, a primary objective of the present invention is to use a copper-foil circuit on a circuit board to replace the conventional design of the conductive pins formed by stamping. Meanwhile, an electronic component or circuit is manufactured on the same circuit board to make the manufacture of the eSATA connector much easier, when it is necessary to add the electronic component or circuit.

To achieve the foregoing objectives, the present invention discloses an improved eSATA connector structure, comprising:

a base, having a containing space defined therein, a retaining wall formed at a front end of the containing space, and an opening formed on the retaining wall, a slideway formed between two sidewalls of the containing space, a bottom tray extended from the bottom of the retaining wall, a gap formed between the retaining wall and the bottom tray, and an engaging portion formed at the bottom of both sidewalls of the containing space and provided for assembling the chassis;

a circuit board, installed in the containing space, and having a plurality of conductive pins made of copper foils, a transmission line segment extended from an end of each conductive pin, and a soldering hole formed at an end of the transmission line segment and soldered to the conductive terminal;

a chassis, having a tray portion coupled onto the base, a retaining portion bent from an end of the tray portion and coupled to a rear side of the base, a plurality of through holes formed on the tray portion and provided for passing the conductive terminals out of the through holes respectively, and a bump formed separately on both lateral sides of the tray portion and coupled to the engaging portion; and a casing, having a hollow main body, a port formed at a front end of the main body, a plurality of elastic plates disposed at the top and bottom of the port respectively, a folding plate disposed at an end of the hollow main body, such that when the base is assembled in the main body, the folding plate is bent to prevent the base from being loosened.

DESCRIPTION OF THE PREFERRED EMBODIMENTS

The technical characteristics and contents of the present invention will become apparent with the following detailed description accompanied with related drawings.

Figure 1:
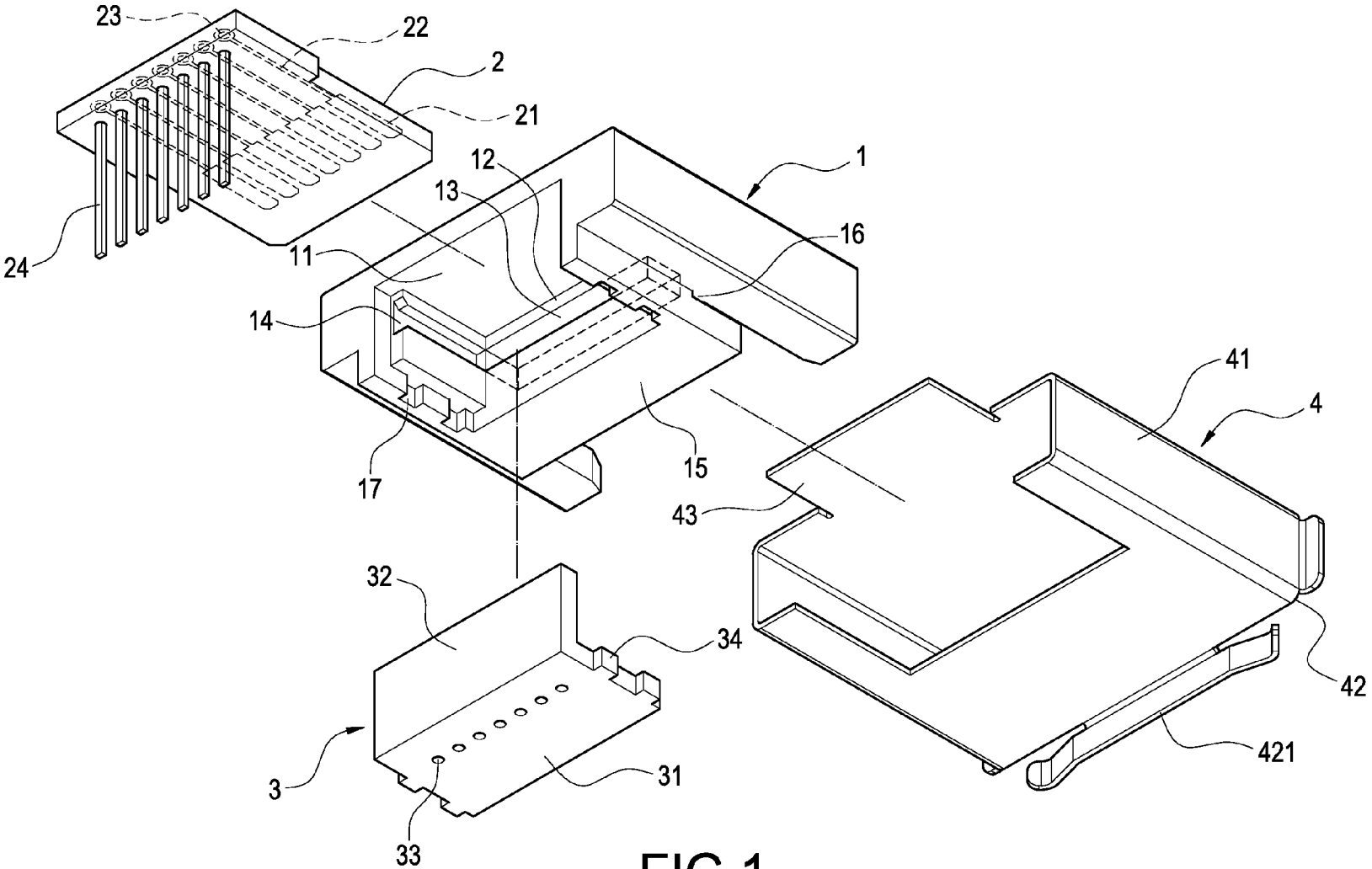
FIG. 1 is an exploded view of an eSATA connector of the present invention.
Figure 2:
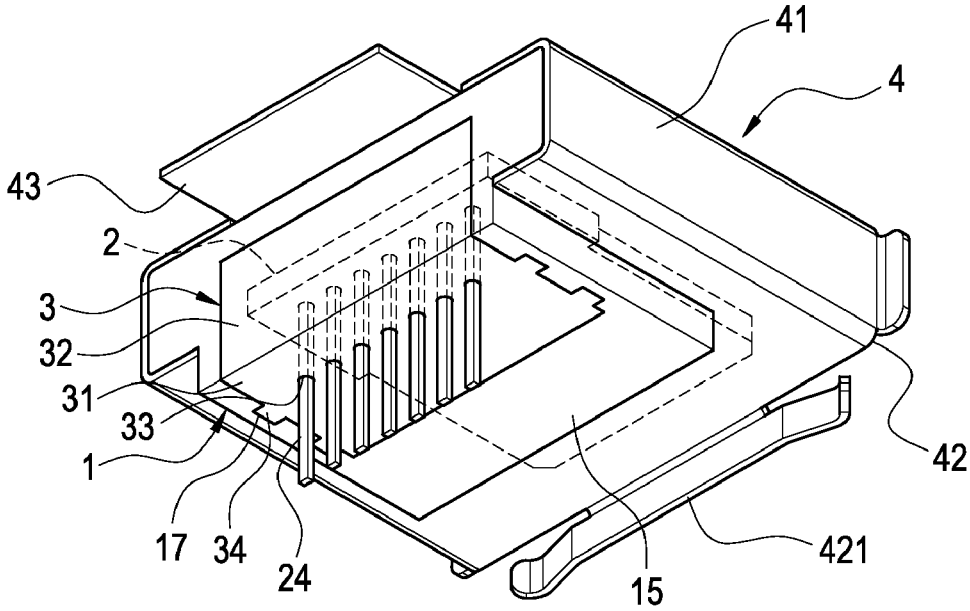
FIG. 2 is a first bottom view of an eSATA connector of the present invention.
Figure 3:
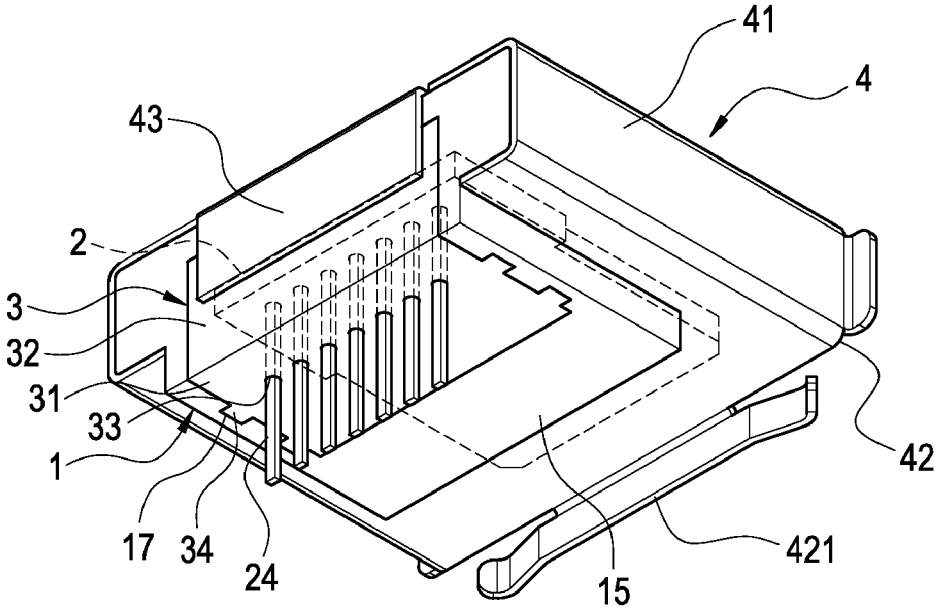
FIG. 3 is a second bottom view of an eSATA connector of the present invention.

With reference to FIGS. 1 to 3 for an exploded view and first and second bottom views of an improved eSATA connector structure in accordance with the present invention respectively, the improved eSATA connector structure comprises a base 1, a circuit board 2, a chassis 3 and a casing 4.

The base 1 is made of an insulating material and includes a containing space 11, a retaining wall 12 formed at a front end of the containing space 11, and an elongated opening 13 formed on the retaining wall 12. In addition, a slideway 14 is formed on both sidewalls of the containing space 11 respectively, and provided for inserting and sliding the circuit board 2 out of the opening 13, and a bottom tray 15 is extended form the bottom of the retaining wall 12, and a gap 16 is formed between the retaining wall 12 and the bottom tray 15 and provided for inserting the bottom of the port 42 of the casing 4, and an engaging portion 17 is formed at the bottom of both sidewalls of the containing space 11 separately and provided for assembling the chassis 3.

The circuit board 2 is installed in the containing space and includes a plurality of conductive pins (or goldfingers) 21 made of a copper foil, and a transmission line segment 22 is extended from an end of the conductive pin 21, and the transmission line segment 22 has a soldering hole 23 formed at an end of the transmission line segment 22 and provided for soldering and coupling the conductive terminal 24.

The chassis 3 is an L-shaped object made of an insulating material and includes a tray portion 31 installed and coupled onto the base 1, a retaining portion 32 bent from an end of the tray portion 31 and coupled to a rear side of the base 1, a plurality of through holes 33 formed on the tray portion 31 and provided for passing the conductive terminals 26 out of the through holes, and a bump 34 formed on both sides of the tray portion 31 separately and coupled to the engaging portion 16.

The casing 4 is made of a metal material and includes a hollow main body 41, a port 42 formed at a front end of the main body 41 and provided for inserting a plug (not shown in the figure) of the transmission line segment, a plurality of elastic plates 421 formed at the top and bottom of the port 42 respectively, and a folding plate 43 installed at an end of the hollow main body, such that when the base 1 is assembled in the main body 41, the folding plate 43 is bent to prevent the base 1 from being loosened.

Figure 4:
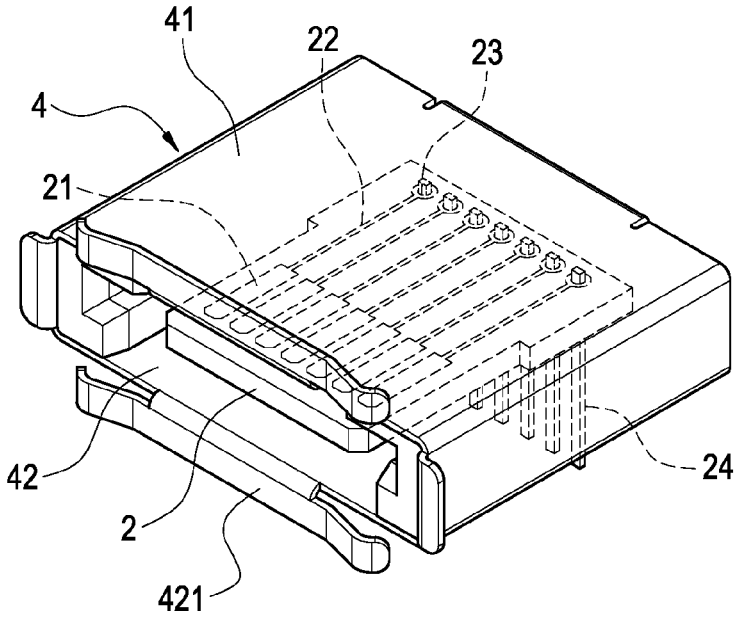
FIG. 4 is a perspective view of an eSATA connector of the present invention.
Figure 5:
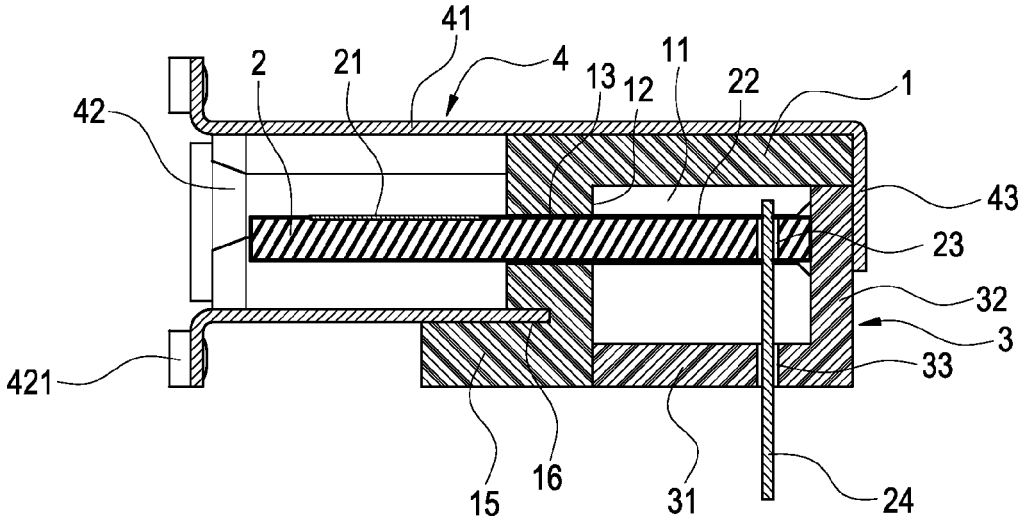
FIG. 5 is a cross-sectional view of an eSATA connector of the present invention.

With reference to FIGS. 4 and 5 for a perspective view and a cross-sectional view of an eSATA connector of the present invention respectively, when the eSATA connector is assembled, the base 1 and the casing 4 are assembled first, and then the circuit board 2 is passed from the containing space 11 through the opening 13, such that the circuit board 2 is situated in the port 42 of the casing 4.

After the base 1, the circuit board 2 and the casing 4 are assembled, the conductive terminals 24 are passed through the through holes 33 of the chassis 3 respectively to mount the chassis 3 onto the base 1, and then the folding plate 43 is installed to complete assembling the whole eSATA connector.

Figure 6:
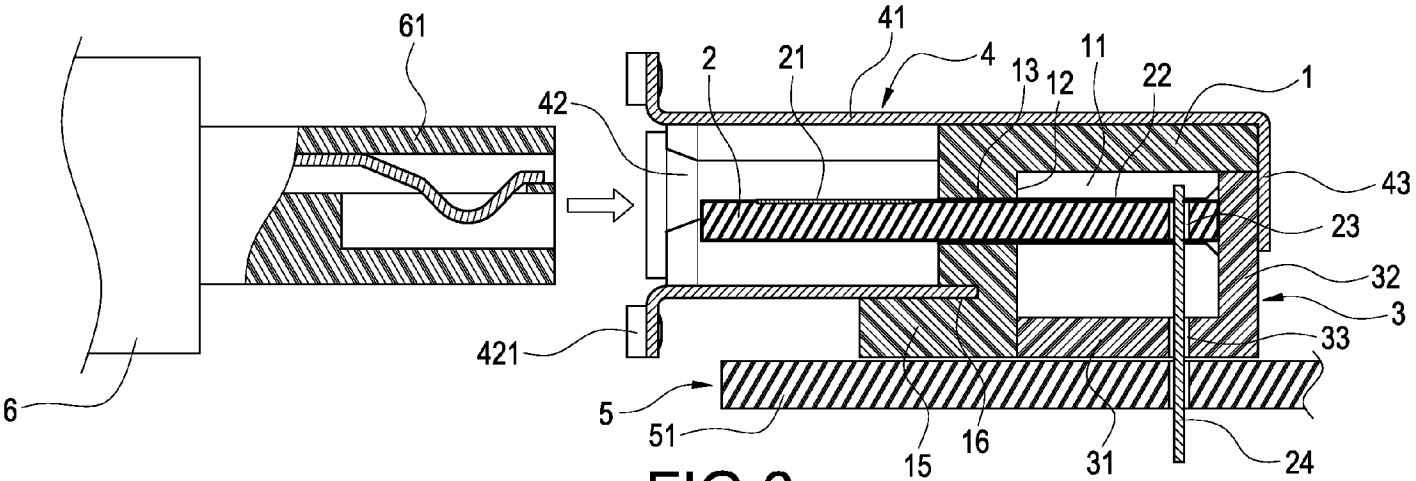
FIG. 6 is a first schematic view of an application of an eSATA connector of the present invention.
Figure 7:
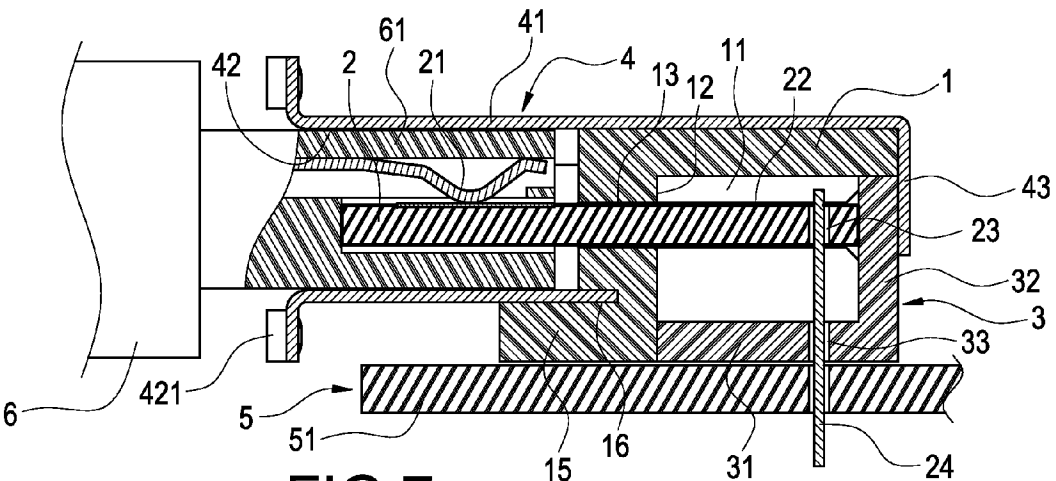
FIG. 7 is a second schematic view of an application of an eSATA connector of the present invention.

With reference to FIGS. 6 and 7 for first and second schematic views of an application of an eSATA connector of the present invention respectively, when the eSATA connector of the present invention is used, the conductive terminals 24 are passed through and electrically coupled to the mainboard 51 of the electronic device 5.

After the eSATA connector is electrically coupled to the mainboard 51, the port 42 of the eSATA connector can be used for inserting and connecting a plug 61 of a transmission line 6 of the eSATA connector.

Figure 8:
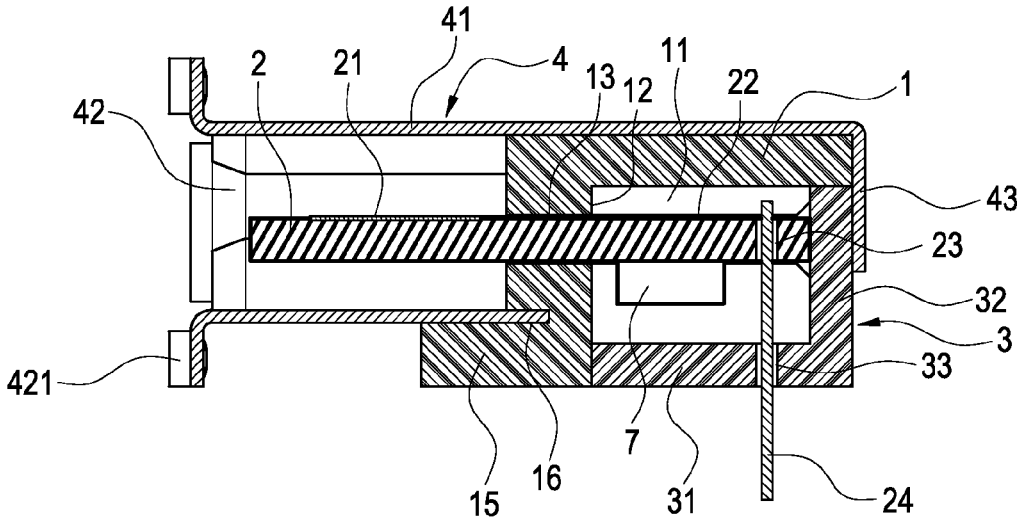
FIG. 8 is a schematic view of an eSATA connector in accordance with a preferred embodiment of the present invention.

With reference to FIG. 8 for a schematic view of an eSATA connector in accordance with a preferred embodiment of the present invention, copper foils on the circuit board 2 are used as the conductive pins 23 of the eSATA connector. In addition, when circuits, electronic components 7 or chips such as a protection circuit, a memory, a microprocessor, and a transceiver circuit are added or installed inside the eSATA connector during the production or manufacturing process, the electronic components 7 can be directly and electrically coupled onto the circuit board 2, such that the eSATA connector no longer requires an additional circuit board 2, so as to make the manufacture simpler and easier.

Figure 9:
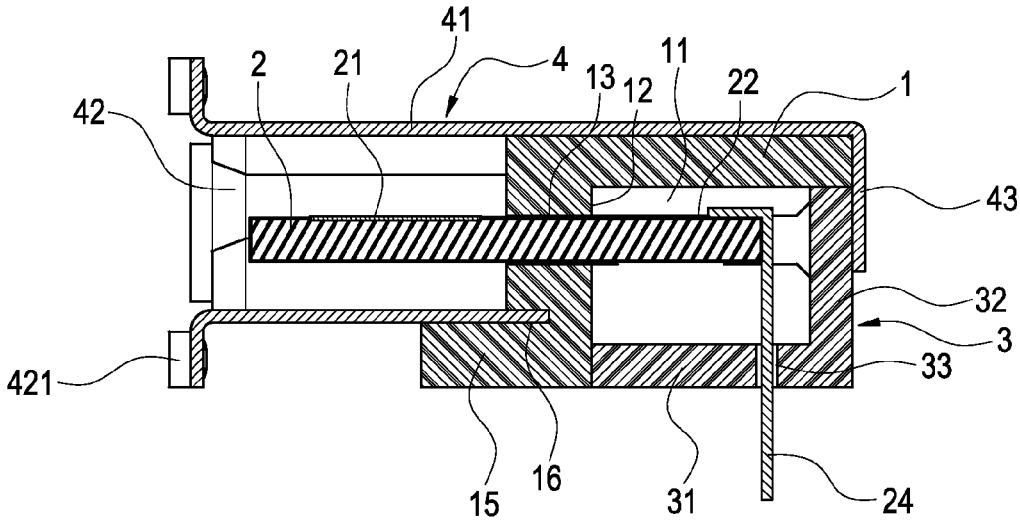
FIG. 9 is a schematic view of an eSATA connector in accordance with another preferred embodiment of the present invention.

With reference to FIG. 9 for a schematic view of an eSATA connector in accordance with another preferred embodiment of the present invention, the circuit board 2 of this embodiment does not have a soldering hole 23, but the conductive terminal 24 and the transmission line segment 22 are soldered together to save the process of manufacturing the soldering holes 23.

While the invention has been described by means of specific embodiments, numerous modifications and variations could be made thereto by those skilled in the art without departing from the scope and spirit of the invention set forth in the claims.

What is claimed is:

1. An improved eSATA connector structure, comprising:

a base having a containing space defined therein, a retaining wall formed at a front end of the containing space, and an opening formed on the retaining wall;

a circuit board installed in the containing space, and an end of the circuit board passing through the opening and out of the retaining wall, at least one side of the circuit board having a plurality of conductive pins, a transmission line segment being extended from an end of the conductive pin, ends of the transmission line segments being respectively and electrically coupled to a plurality of conductive terminals;

a slideway separately formed on both sidewalls of the containing space; and a casing mounted onto the exterior of the base, the casing having a hollow main body and a port formed at a front end of the main body for exposing the circuit board, wherein the base is made of an insulating material, and wherein the retaining wall includes a bottom tray extended from the bottom of the retaining wall, and a gap is defined between the retaining wall and the bottom tray.

2. The improved eSATA connector structure of claim 1, wherein the port includes a plurality of elastic plates disposed at upper and lower peripheries of the port.

3. The improved eSATA connector structure of claim 2, wherein the hollow main body includes a folding plate formed at an end of the main body.

4. The improved eSATA connector structure of claim 1, wherein the conductive pin is a copper foil disposed on the circuit board.

5. The improved eSATA connector structure of claim 4, wherein the conductive pin is a goldfinger.

6. The improved eSATA connector structure of claim 1, wherein the circuit board includes an electronic component electrically coupled to the circuit board.

7. The improved eSATA connector structure of claim 6, wherein the circuit board further includes an electronic circuit installed thereon.

8. The improved eSATA connector structure of claim 1, wherein the circuit board includes a plurality of soldering holes formed thereon, and electrically coupled to an end of the transmission line segment and the conductive terminals.

9. An improved eSATA connector structure, comprising:

a base having a containing space defined therein, a retaining wall formed at a front end of the containing space, and an opening formed on the retaining wall, wherein the base is made of an insulating material;

a circuit board installed in the containing space, and an end of the circuit board passing through the opening and out of the retaining wall, at least one side of the circuit board having a plurality of conductive pins, a transmission line segment being extended from an end of the conductive pin, ends of the transmission line segments being respectively and electrically coupled to a plurality of conductive terminals;

a slideway separately formed on both sidewalls of the containing space;

an engaging portion formed at the bottom of both sidewalls of the containing space separately; and a casing mounted onto the exterior of the base, the casing having a hollow main body and a port formed at a front end of the main body for exposing the circuit board.

10. The improved eSATA connector structure of claim 9, further comprising a chassis, and the chassis being an L-shaped object made of an insulating material and having a tray portion coupled to the base, the tray portion having a retaining portion bent from an end of the tray portion, the retaining portion being coupled to the rear side of the base, the tray portion further having a plurality of through holes for passing the conductive terminals out from the through holes respectively, and a bump formed on both sides of the tray portion separately and coupled to the engaging portion.

* * * * *